United States Patent [19]

Kaufmann

[11] 4,346,981

[45] Aug. 31, 1982

[54] DUAL RATE AUTOMATIC ANTI-OXIDATION REPLENISHER CONTROL

[75] Inventor: Kenneth M. Kaufmann, Minneapolis, Minn.

[73] Assignee: Pako Corporation, Del.

[21] Appl. No.: 263,868

[22] Filed: May 15, 1981

Related U.S. Application Data

[63] Continuation-in-part of Ser. No. 168,020, Jul. 14, 1980, Pat. No. 4,295,729.

[51] Int. Cl.[3] ..... G03D 3/06

[52] U.S. Cl. ..... 354/324; 137/624.15; 222/644

[58] Field of Search ..... 354/298, 324; 355/10, 355/27; 137/624.15; 222/70; 250/559; 356/443, 444

[56] References Cited

U.S. PATENT DOCUMENTS

| | | | |
|---|---|---|---|
| 3,472,132 | 10/1969 | Hixon et al. | 95/89 |
| 3,529,529 | 9/1970 | Schumacher | 95/89 |
| 3,554,109 | 1/1971 | Street | 95/89 |
| 3,559,555 | 2/1971 | Street | 95/89 |
| 3,561,344 | 2/1971 | Frutiger | 95/89 |
| 3,696,728 | 10/1972 | Hope | 95/89 |
| 3,752,052 | 8/1973 | Hope et al. | 95/89 |
| 3,787,689 | 1/1973 | Fidelman | 250/219 |
| 3,822,723 | 7/1974 | Crowell et al. | 137/624.15 |
| 3,927,417 | 11/1975 | Kinoshita et al. | 354/298 |
| 3,990,088 | 11/1976 | Takita | 354/298 |
| 4,057,818 | 11/1977 | Gaskell et al. | 354/298 |
| 4,104,670 | 8/1978 | Charnley et al. | 354/324 |
| 4,119,952 | 10/1978 | Takahashi et al. | 340/309 |
| 4,128,325 | 12/1978 | Melander et al. | 354/298 |
| 4,134,663 | 1/1979 | Laar et al. | 354/298 |
| 4,174,169 | 11/1979 | Melander et al. | 354/324 |

OTHER PUBLICATIONS

Luth, *Elektronic-Film-Processor 1200/48 "E; LT600/24 "E.*

*Primary Examiner*—L. T. Hix
*Assistant Examiner*—William B. Perkey
*Attorney, Agent, or Firm*—Kinney, Lange, Braddock, Westman and Fairbairn

[57] ABSTRACT

A processor of photosensitive material includes an automatic control system for providing anti-oxidation replenishment. The control system includes a real time clock for providing an indication of the time of day, and means for storing a schedule of operating hours of the processor. The control system controls anti-oxidation replenishment as a function of the time of day and the schedule of operation. In one embodiment, the control system provides anti-oxidation replenishment on a twenty-four hour basis (even during nonoperating hours) by operating the developer circulation pump and the anti-oxidation replenishment pump on a periodic basis during nonoperating hours. In another embodiment, which is particularly useful when there are restrictions against leaving on electric power to the processor during nonoperating hours, the control system adds a bulk amount of anti-oxidation replenishment at the time of turn-on of the processor. This bulk amount of anti-oxidation replenishment is a function of the time of turn-on and the last turn-off time. Anti-oxidation replenishment is supplied at a first rate for operating time of the processor, and at a second, lower rate for nonoperating time of the processor.

9 Claims, 1 Drawing Figure

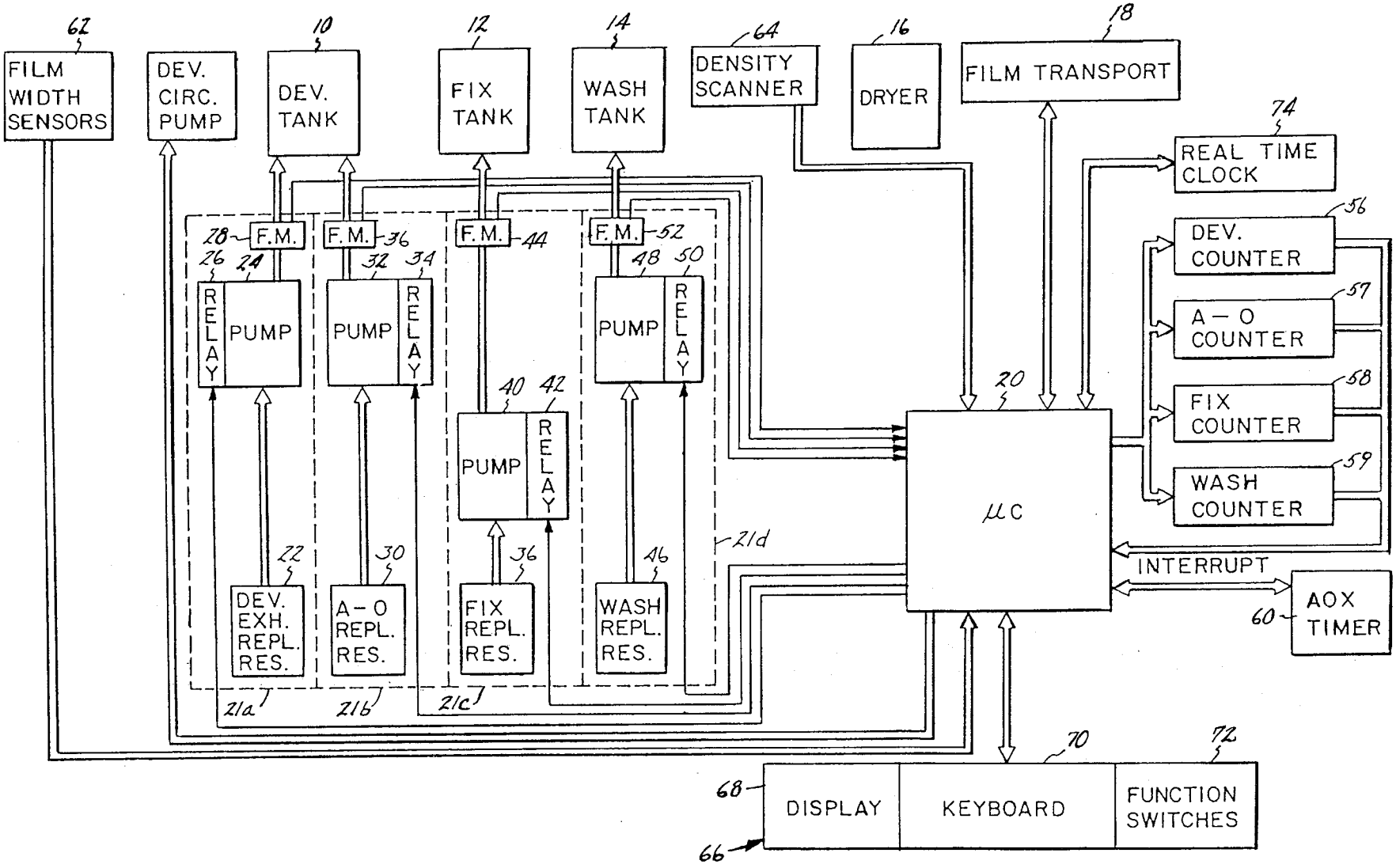
REAL TIME CLOCK
74
DEV. COUNTER
56
A-O COUNTER
57
FIX COUNTER
58
WASH COUNTER
59
AOX TIMER
60
INTERRUPT
FILM TRANSPORT
18
DRYER
16
DENSITY SCANNER
64
μC
20
FUNCTION SWITCHES
72
KEYBOARD
70
DISPLAY
68
66
WASH TANK
14
FIX TANK
12
DEV. TANK
10
DEV. CIRC. PUMP
FILM WIDTH SENSORS
62
F.M.
52
48
50
PUMP
RELAY
WASH REPL. RES.
46
21d
F.M.
44
40
42
FIX REPL. RES.
36
21c
F.M.
36
32
34
A-O REPL. RES.
30
21b
F.M.
28
26
24
DEV. EXH. REPL. RES.
22
21a

DUAL RATE AUTOMATIC ANTI-OXIDATION REPLENISHER CONTROL

REFERENCE TO CO-PENDING APPLICATIONS

This application is a continuation-in-part of U.S. patent application Ser. No. 168,020, filed July 14, 1980 and now U.S. Pat. No. 4,295,729.

Reference is also hereby made to a co-pending application Ser. No. 168,019, filed July 14, 1980, now U.S. Pat. No. 4,293,211, entitled AUTOMATIC REPLENISHER CONTROL SYSTEM and assigned to the same assignee as this application.

BACKGROUND OF THE INVENTION

1. Field of the Invention

The present invention relates to an antioxidation replenisher control system for use in processors of photosensitive material.

2. Description of the Prior Art

Automatic photographic film and paper processors transport sheets or webs of photographic film or paper through a sequence of processor tanks in which the photosensitive material is developed, fixed, and washed, and then transports the material through a dryer. It is well known that photographic processors require replenishment of the processing fluids to compensate for changes in the chemical activity of the fluids.

First, it has been recognized that replenishment is necessary to replace constituents used as photosensitive film or paper is developed in the processor. This replenishment is "use related" or "exhaustion" chemical replenishment. Both developer and fix solutions require exhaustion replenishment.

Second, degradation of the chemical activity of the developer solution due to aerial oxidation occurs with the passage of time regardless of whether any film or paper is being processed. Some replenishment systems provide additional replenishment of an "anti-oxidation" (A-O) replenishment solution which counteracts this deterioration.

Replenishment systems were originally manually operated. The operator would visually inspect the processed film or paper and manually operate a replenisher system as he deemed necessary. The accuracy of the manual replenisher systems was obviously dependent upon the skill and experience of the operator.

Various automatic replenishment systems have been developed for providing use-related replenishment. Examples of these automatic replenishment systems include U.S. Pat. Nos. 3,472,143 by Hixon et al; 3,529,529 by Schumacher; 3,554,109 by Street et al; 3,559,555 by Street; 3,561,344 by Frutiger et al; 3,696,728 by Hope; 3,752,052 by Hope et al; 3,787,689 by Fidelman; 3,927,417 by Kinoshita et al; 3,990,088 by Takita; 4,057,818 by Gaskell et al.; 4,104,670 by Charnley et al.; 4,119,952 by Takahashi et al.; 4,128,325 by Melander et al.; and 4,134,663 by Laar et al. Examples of prior art replenisher controls for providing both exhaustion and anti-oxidation replenishment are shown in U.S. Pats. 3,822,723 by Crowell et al. and 4,174,169 by Melander et al.

SUMMARY OF THE INVENTION

The automatic control system of the present invention recognizes that generally a processor of photosensitive material is not operated on a continuous twenty-four hour basis. Oxidation of the replenisher solution, however, continues even during nonoperating hours of the processor. The control system of the present invention provides anti-oxidation replenishment so that the developer solution will have the desired chemical activity when normal operation of the processor commences again after a period of nonoperation. The present invention further recognizes that the rate of aerial oxidation is generally lower during prolonged nonoperating periods than during normal operation of the processor.

The control system of the present invention, therefore, controls the providing of anti-oxidation replenishment as a function of operating and nonoperating periods of the processor. Anti-oxidation replenishment is provided at a first rate for operating periods; and at a second, lower rate for non-operating periods.

BRIEF DESCRIPTION OF THE DRAWINGS

The FIGURE is a block diagram illustrating a preferred embodiment of the automatic anti-oxidation replenishment control system of the present invention.

DETAILED DESCRIPTION OF PREFERRED EMBODIMENTS

In the system shown in the FIGURE, a photographic processor includes developer tank 10, fix tank 12, wash tank 14, and dryer 16. Film transport drive 18 transports the strip or web of photosensitive material (either film or paper) through tanks 10, 12, 14 and dryer 16. Microcomputer 20 controls operation of film transport 18 and of the automatic replenishment of fluids to tanks 10, 12 and 14.

The auto-replenishment system shown in the FIGURE includes developer replenisher **21*a* and anti-oxidation replenisher 21*b* for providing exhaustion and anti-oxidation replenishment, respectively to developer tank 10. In addition, the system includes fix replenisher 21*c* for providing fix replenishment to fix tank 12, and wash replenisher 21*d* for providing wash replenishment to wash tank 14**.

Developer replenisher **21*a* includes exhaustion replenishment reservoir 22, pump 24, pump relay 26, and flow meter or switch 28. Exhaustion replenishment for developer tank 10 is supplied from exhaustion replenishment reservoir 22 by means of pump 24. Microcomputer 20 controls operation of pump 24 through pump relay 26. Flow meter or switch 28 monitors the exhaustion replenishment fluid actually pumped by pump 24 to developer tank 10, and provides a feedback signal to microcomputer 20**.

Anti-oxidation replenisher **21*b* includes A-O replenisher reservoir 30, pump 32, pump relay 34, and flow meter or switch 36. Anti-oxidation replenishment is supplied from A-O replenisher reservoir 30 to developer tank 10 by pump 32. Microcomputer 20 controls operation of pump 32 by means of relay 34. Flow meter or switch 36 monitors flow of A-O replenishment to developer tank 10 and provides a feedback signal to microcomputer 20**.

Also shown in the FIGURE is developer circulation pump 37, which circulates the developer solution within developer tank 10. Microcomputer 20 controls operation of developer circulation pump 37.

Fix replenisher **21*c* includes fix replenisher reservoir 38, pump 40, pump relay 42, and flow meter or switch 44. Fix replenishment is supplied to fix tank 12 from fix replenisher reservoir 38 by pump 40, which is controlled by microcomputer 20 through relay 42. Flow meter or switch 44 monitors flow of replenishment fluid to fix tank 12, and supplies a feedback signal to microcomputer 20**.

Wash replenisher 21*d*, which includes wash reservoir 46, pump 48, pump relay 50, and flow meter or switch 52, provides replenishment of wash fluid (typically water) in wash tank 14. The wash fluid is supplied from wash replenishment reservoir 46, and is pumped to wash tank 14 by pump 48. Microcomputer 20 controls pump 48 through relay 50, and monitors the flow of wash replenishment to tank 14 by means of flow meter or switch 52.

Microcomputer 20 utilizes developer counter 56, A-O counter 57, fix counter 58, and wash counter 59 as timers to control replenishment. When, for example, exhaustion replenishment is required, microcomputer 20 loads a numerical value (DEVTIME) into developer counter 56, which then begins counting. Microcomputer 20 energizes relay 26, which actuates pump 24. When developer counter 56 reaches a predetermined value (such as zero), it provides an interrupt signal to microcomputer 20, which de-energizes relay 26. The numerical value (DEVTIME), therefore, determines the total amount of exhaustion developer replenisher pumped into tank 10.

Counters 57, 58 and 59 are operated in a similar manner. The numerical values loaded into counters 57, 58 and 59 are hereafter referred to as AOXTIME, FIXTIME and WASHTIME, respectively.

AOX timer 60 is a free running timer which provides an interrupt signal to microcomputer 20 on a periodic basis to initiate A-O replenishment. In one preferred embodiment, AOX timer 60 provides the interrupt signal every 22.5 minutes.

Microcomputer 20 also receives signals from film width sensors 62 and density scanner 64. Film width sensors 62 are positioned at the input throat of the processor, and provide signals indicating the width of the strip of photosensitive material as it is fed into the processor. Since microcomputer 20 also controls film transport 18, and receives feedback signals from film transport 18, the width signals from film width sensors 62 and the feedback signals from film transport 18 provide an indication of the area of photosensitive material being processed.

Density scanner 64 senses density of the processed photosensitive material. The signals from density scanner 64 provide an indication of the integrated density of the processed photosensitive material. The integrated density, together with the area of material processed, provides an indication of the amount of processor fluids used in processing that material.

Microcomputer 20 also receives signals from control panel 66, which includes function switches 68, keyboard 70, and display 72. Function switches 68 select certain functions and operating modes of the processor. Keyboard 70 permits the operator to enter numerical information, and other control signals used by microcomputer 20 in controlling operation of the processor, including replenishment. Display 72 displays message or numerical values in response to control signals from microcomputer 20.

The A-O replenishment control system of the present invention includes real time clock 74. Real time clock 74 maintains the time of day, and preferably is provided with battery backup power so that it continues to operate even when power to the processor is turned off.

Microcomputer 20 preferably stores set values for each of a plurality of photosensitive materials that may be processed in the processor. Each group of set values includes pump rates for pump 24 (DEVPMRTE), pump 32 (AOXPMRTE), pump 40 (FIXPMRTE) and pump 48 (WASHPMPRTE); desired replenishment rates of exhaustion developer (DEVRATE) A-O replenishment (AOXRATE), fix replenishment (FIXRTE), and wash replenishment (WASHRATE).

When operation is commenced, the operator selects one of the groups of set values which corresponds to the particular photosensitive material being processed. As the leading edge of each strip of photosensitive material is fed into the processor, film width sensors 62 sense the presence of the strip, and provide a signal indicative of the width of the strip being fed into the processor. Width sensors 62 continue to provide the signal indicative of the width of the strip until the trailing edge of the strip passes sensors 62. The occurrence of the leading and trailing edges of the material passing sensors 62, permits microcomputer 20 to determine the length of the strip. The width and length information for each strip is stored until the strip has been transported through the processor and reaches density scanner 64. The area of the strip and the integrated density of the strip (which is provided by the signals from density scanner 64), provide an indication of the amounts of developer and fix which have been exhausted in processing that particular strip.

The present invention is an improved system for automatically controlling A-O replenishment. For that reason, a detailed description of developer exhaustion, fix, and wash replenishment is not provided in this application. Reference may be made to the previously mentioned co-pending patent application entitled "Automatic Replenisher Control System" for further details.

The anti-oxidation replenishment takes one of two forms, depending upon the particular developer chemistry used. One type of anti-oxidation replenishment is known as "blender chemistry", and the other type is known as "dual" or "two-part chemistry".

Blender chemistry is based upon a "minimum daily requirement" of anti-oxidation replenishment. This minimum daily requirement is dependent upon the amount of aerial oxidation which occurs in developer tank 10, which in turn is dependent upon the open surface area of tank 10, the operating temperature of the developer solution, and a number of other factors. With blender chemistry, some anti-oxidation replenishment is provided each time anti-oxidation replenishment is provided each time exhaustion replenishment occurs. The more exhaustion replenishment provided, the less separate anti-oxidation replenishment is required.

For two-part chemistry, on the other hand, the anti-oxidation replenishment is independent of exhaustion replenishment. Two-part chemistry replenishment is based upon a daily requirement of anti-oxidation replenishment, which is unaffected by the amount of material processed in the processor and the amount of exhaustion replenishment provided.

The replenishment control system of one preferred embodiment of the present invention controls anti-oxidation replenishment on the basis of 22.5 minute intervals. During a twenty-four hour day, there are sixty-four intervals of 22.5 minutes each. AOX timer 60 provides interrupt signals to microcomputer 20 at the 22.5 minute intervals.

In the case of blender chemistry replenishment, microcomputer 20 adjusts the amount of antioxidation replenishment at the end of each 22.5 minute interval as a function of the amount of exhaustion replenishment which was provided during the 22.5 minute interval. If no film or paper has been run through the processor during the 22.5 minute interval, so that no exhaustion replenishment has occurred, microcomputer 20 actuates relay 34 to run pump 32 for a time period sufficient to provide 1/64th of the minimum daily requirement. If exhaustion replenishment has occurred during the 22.5 minute interval, microcomputer 20 reduces the operating time of pump 32 accordingly. If film or paper is being processed at a high enough rate during the 22.5 minute interval, no blender anti-oxidation replenishment is required, and microcomputer 20 does not activate pump 32.

In the case of two-part chemistry, microcomputer 20 actuates relay 34 at the end of each 22.5 minute interval. Relay 34 is energized for a period long enough to permit pump 32 to pump 1/64th of the daily requirement of two-part chemistry replenishment.

Anti-oxidation replenishment is real time dependent, not simply operating time dependent. In other words, aerial oxidation of the developer solution continues even during those hours that the processor is turned off and no material is being processed. This, of course, is the usual situation in many businesses—the processor is not operated at night or on the weekends.

The problem which can be encountered with extended nonoperating periods is that the chemical activity of the developer solution continues to degrade due to aerial oxidation, although at a somewhat lower rate than when the processor is up to temperature and operating. When the processor is again started, the chemical activity of the developer solution is out of range, and it takes some time before the developer solution can be replenished to a point at which it can be used. This results in lost production time at the beginning of each day.

In general, the longer the period in which the processor is not operated, the greater the amount of aerial oxidation which can occur. When the processor is not used over a weekend, the problem can be even worse than when the processor is not used overnight.

The anti-oxidation replenishment control system of the present invention solves these problems by use of real time clock 74, which maintains the current time of day. Microcomputer 20 stores an operating schedule for the processor for each day of the week. In the preferred embodiment, this operating schedule is in terms of a TIMEON time and a TIMEOFF time for each day of the week. This schedule of operating and nonoperating times is entered into microcomputer 20 by the operator through keyboard 70.

In some facilities, there are restrictions against leaving power on to the processor during nonoperating hours. In this type of situation, the present invention replenishes anti-oxidation replenishment on power up after any down time.

When the processor is initially turned on, the POWER switch is first turned to the standby position. Microcomputer 20 calculates the bulk anti-oxidation replenishment based upon the difference between the actual time (ACTIME) and the last time off time.

It then calculates the bulk amount of anti-oxidation replenishment which should be added as a function of the actual time of day (ACTIME) and the last time (TIMEOFF) when the processor was turned off. Microcomputer 20 then calculates AOXTIME, which is loaded into anti-oxidation counter 57 and energizes relay 34. When counter 57 reaches zero, pump 32 is turned off, thereby ending the bulk anti-oxidation replenishment.

When there are no restrictions at the processor installation point against continuously leaving the processor with a live electrical input (i.e. even during normal nonoperating hours), the anti-oxidation replenishment system of the present invention replenishes on a real time twenty-four hour schedule. If the processor is not being used, microcomputer 20 activates anti-oxidation replenishment pump 32 as required. After a suitable replenishment time, microcomputer 20 turns off pump 32 and shuts down the processor until the end of the next interval (e.g. 22.5 minutes) when anti-oxidation replenishment is again provided.

In this preferred embodiment of the present invention, microcomputer 20 also preferably turns the processor on in the morning and off at night. The turn-on time is preferably selected so that the processor is replenished, up to temperature, and ready for operation at the beginning of the normal work day.

When extended non-operating periods are scheduled, such as over a weekend, microcomputer 20 also preferably adjusts either the bulk additions or the periodic additions of anti-oxidation replenishment accordingly. Since extended non-operating periods normally mean that the temperature of the developer solution will eventually reach room temperature, the rate of aerial oxidation will be affected, since it is temperature dependent. In one preferred embodiment, microcomputer 20 determines whether the nonoperating period exceeds twenty-four hours, the replenishment rate (AOXRTE) for the bulk additions or the periodic nonoperating hours replenishment is divided in half (or by some other selected value K which reflects the reduced aerial oxidation during non-operating hours). If the anti-oxidation replenishment rate were not reduced to compensate for the lower oxidation during nonoperating periods, overreplenishment could occur.

In another preferred embodiment, microcomputer 20 maintains accumulated time values T1 and T2, representing accumulated operating and nonoperating time during each 22.5 minute interval. If the processor is continuously "ON" during the interval, T1=22.5 minutes and T2=0. Conversely, if the processor is continuously "OFF" during the interval, T1=0 and T2=22.5 minutes. When the processor changes from "ON" to "OFF" or vice versa during the interval, T1 and T2 both have non-zero values which total 22.5 minutes.

Table B illustrates how microcomputer 20 determines and controls anti-oxidation replenishment for both during normal operating hours and nonoperating hours. Step B.15 is specifically concerned with the embodiment of the present invention in which bulk additions are made upon power up of the processor. Step B.16 is concerned with the embodiment of the present invention in which anti-oxidation replenishment continues at 22.5 minutes intervals on a twenty-four hour basis, even throughout the non-operating hours.

TABLE B

| | |
|---|---|
| B.1 | AOX timer 60 times out (22.5 min.) free run) |
| B.2 | If BLENDER chemistry then |
| | (1) AOXREPL = |

TABLE B-continued $$\frac{AOXRATE^*}{64}\left(\frac{TI}{22.5}+\frac{T2}{K^*22.5}\right) - AOXDEV$$

(2) Reset AOXDEV, T1, T2

$$\text{else } AOXREPL = \frac{AOXRATE^*}{64}\left(\frac{T1}{22.5}+\frac{T2}{K^*22.5}\right)$$

(i.e.) if TWO-PART chemistry), Reset T1, T2

B.3 AOXTIME = AOXREPL ÷ AOXPMPRT + AOXMINRUN

B.4 If AOXTIME less than 7.5 seconds then
(1) Calculate AOXMINRUN = AOXMINRUN + AOXTIME
(2) Return to B.1

B.5 Output AOXTIME to counter 57

B.6 Trigger pulse sent to counter 57 and
(1) Replenish flag (AOX) set

B.7 Counter 57 begins decrementing and
(1) Anti-ox replenishment pump 32 runs
(2) When counter 57 times out go to B.10

B.8 If flow switch 36 does not activate and/or Anti-ox replenishment pump relay 34 does not energize then ERROR B.9 If pump enable is turned off while counter 57 is running then
(1) Wait 5 seconds
(2) If change then resume B.7
else
(a) Read value remaining in counter 57 to AOXREM
(b) Clear counter 57
(c) Replenish flag (AOX) reset
(d) Return to B.1

B.10 Counter 57 times out and
(1) Interrupt request generated

B.11 If Interrupt request not acknowledged then wait; else

B.12 If flow switch 36 remains activated and/or pump relay 34 remains energized, then ERROR; else B.13 Reset replenish (AOX) flag and AOX not complete flag and clear AOXMINRUN B.14 Return to B1 or if TIMEOFF to B.16

B.15 If POWER switch changes to ON or timer to TIMEON
(1) Generate high priority interrupt
(2) Calculate BULKAOX = (ACTIME − TIMEOFF)* (AOXRATE ÷ (144*K)
(3) Calculate BULKTIME = BULKAOX ÷ AOXPMRTE
(4) If BULKTIME is less than 715 seconds then
(a) Clear BULKTIME
(b) Clear BULKAOX
(5) Calculate AOXREPL = BULKAOX
(6) Calculate AOXTIME = BULKTIME
(7) Return to B.5

B.16 If TIME-OFF and AOX timer 60 times out then go to B.2

Although the specific embodiment of the present invention discussed above is a system in which anti-oxidation replenishment is provided at fixed time intervals, with variable amounts of anti-oxidation replenishment being provided, the present invention is equally applicable to other anti-oxidation replenishment systems. For example, the present invention is also applicable to anti-oxidation replenishment systems in which a fixed amount of anti-oxidation replenishment is provided, but the time intervals between anti-oxidation replenishment vary as a function of the amount of exhaustion replenishment provided. An example of a system of this type is shown in U.S. Pat. No. 4,174,169 by Melander et al., which is assigned to the assignee of the present application. In the Melander patent, a predetermined value is set in a counter at the beginning of each anti-oxidation replenishment interval. The counter is counted down at a rate representative of aerial aoxidation, and is counted up whenever exhaustion replenishment occurs. The effect of this operation is to provide anti-oxidation replenishment at a variable time interval which depends upon the amount of exhaustion replenishment provided during the interval. In another embodiment of the present invention, two rates of counting down the counter in the system of Melander et al. are provided. The first, higher rate or frequency is used when the processor is operating, and a second, lower rate or frequency is used to count down the counter during nonoperating periods. This has the effect of providing longer time intervals between anti-oxidation replenishment as a result of nonoperating time of the processor, while still providing the necessary anti-oxidation replenishment. This embodiment of the present invention is implemented either in hardware like that shown in the Melander et al. patent, or the same functions are performed by microcomputer 20 in the system illustrated in the figure of the present application. In either case, the time interval between anti-oxidation replenishment is a function of the operating time of the processor, the nonoperating time of the processor, and (in the case of blender chemistry) the amount of exhaustion replenishment provided.

CONCLUSION

The anti-oxidation replenishment control system of the present invention provides far more accurate anti-oxidation replenishment, since it takes into account aerial oxidation which occurs during nonoperating periods of the processor. With the present invention, therefore, delays when beginning a day in order to bring the chemical activity of the developer solution back into the desired range are substantially reduced. This can significantly reduce lost production tme.

Although the present invention has been described with reference to preferred embodiments, workers skilled in the art will recognize that changes may be made in form and detail without departing from the spirit and scope of the invention.

What is claimed is:

1. In a processor of photosensitive material in which anti-oxidation replenishment is provided, the improvement comprising:

means for storing a first replenishment rate and a second, lower replenishment rate;

means for providing a first signal indicative of operating time of the processor;

means for providing a second signal indicative of non-operating time of the processor; and anti-oxidation control means for controlling the anti-oxidation replenishment at the first replenishment rate as a function of the first signal to compensate for changes in chemical activity of processor fluid due to aerial oxidation under normal operating conditions of the processor, and for controlling anti-oxidation replenishment at the second, lower rate as a function of the second signal to compensate for changes in chemical activity of the processor fluid due to aerial oxidation of the processor solution under non-operating conditions of the processor.

2. The invention of claim 1 wherein the anti-oxidation control means provides anti-oxidation replenishment at the end of a period of non-operation as a function of the second replenishment rate and the non-operating time duration of the period.

3. In a processor of photosensitive material of the type having exhaustion replenisher means for providing exhaustion chemical replenishment as a function of sensed parameters related to need for exhaustion chemical replenishment and anti-oxidation replenisher means for providing anti-oxidation chemical replenishment, a control system comprising:

means for storing a first replenishment rate related to aerial oxidation of the processor under normal operating conditions of the processor, and a second, lower anti-oxidation rate related to aerial oxidation of the processor solution in the processor under non-operating conditions of the processor;

means for providing an indication of whether the processor is in an operating or a nonoperating condition; and anti-oxidation replenisher control means for controlling the anti-oxidation replenisher means to provide anti-oxidation chemical replenishment as a function of the first anti-oxidation replenishment rate, the second anti-oxidation replenishment rate, the exhaustion chemical replenishment provided, and whether the processor is in an operating or non-operating condition.

4. A method of providing anti-oxidation chemical replenishment in a processor of photosensitive material, the method comprising:

providing a value representative of a time interval until anti-oxidation chemical replenishment;

changing the value at a first rate to change the time interval as a function of operating time of the processor;

changing the value at a second, lower rate to change the time interval as a function of non-operating time of the processor; and providing anti-oxidation chemical replenishment when the time interval is ended.

5. The method of claim 4 wherein changing the value at the first rate reduces the time interval and changing the value at the second rate reduces the time interval.

6. In a processor of photosensitive material in which anti-oxidation replenishment is provided to processor fluid to compensate for changes in chemical activity of the processor fluid due to aerial oxidation, control means for controlling anti-oxidation replenishment comprising:

means for providing a first signal determinative of anti-oxidation replenishment required as a result of aerial oxidation of processor solution during operation of the processor;

means for providing a second signal determinative of anti-oxidation replenishment required to compensate for changes in chemical activity of the processor fluid due to aerial oxidation during non-operation of the processor; and means for providing anti-oxidation chemical replenishment during periods of operation as a function of the first signal and providing anti-oxidation replenishment at the end of each period of non-operation as a function of the second signal and the duration of the period of non-operation.

7. In a processor of photosensitive material in which anti-oxidation replenishment is provided, the improvement comprising:

means for storing a first replenishment rate and a second replenishment rate;

means for controlling anti-oxidation replenishment during operating periods of the processor based upon the first replenishment rate to compensate for changes in chemical activity of processor fluid due to aerial oxidation under normal operating conditions of the processor; and means for causing a bulk addition of the anti-oxidation replenishment to be provided upon commencement of an operating period of the processor after a non-operating period, the bulk addition of the anti-oxidation replenishment being a function of time duration of the non-operating period and the second replenishment rate.

8. The invention of claim 7 and further comprising:

real time clock means for providing a time of day;

means responsive to the time of day signals for storing the time of day corresponding to the end of a preceding operating period; and means for determining the time duration of the non-operating period based upon the stored time of day corresponding to the end of the preceeding operating period and a time of day signal indicative of commencement of the operating period after the non-operating period.

9. In a processor of photosensitive material in which anti-oxidation replenishment is provided, the improvement comprising:

means for providing a signal indicative of the time duration of a non-operating period of the processor during which processor fluids are not maintained under normal operating conditions of the processor; and means for providing, at commencement of an operating period after the non-operating period, a bulk addition of anti-oxidation replenishment which is a function of the signal indicative of the time duration of the non-operating period to compensate for changes in chemical activity of the processor fluid due to aerial oxidation of the processor solution during the non-operating period.

* * * * *